United States Patent [19]

Terada et al.

[11] Patent Number: 4,857,225

[45] Date of Patent: Aug. 15, 1989

[54] CLEANING CHEMICAL FOR ALUMINIUM SURFACE

[75] Inventors: Haruyoshi Terada; Youji Ono; Yokichi Satoh; Hideaki Kaneko, all of Tokyo, Japan

[73] Assignee: Nihon Parkerizing Co., Ltd., Japan

[21] Appl. No.: 142,128

[22] Filed: Jan. 11, 1988

[30] Foreign Application Priority Data

Jan. 12, 1987 [JP] Japan ..... 62-4778

[51] Int. Cl.[4] ..... C11D 7/54; D06L 3/00

[52] U.S. Cl. ..... 252/100; 252/79.3; 252/79.4; 252/95; 252/142; 252/148; 134/3; 134/40; 134/41

[58] Field of Search ..... 252/79.2, 79.3, 79.4, 252/95, 100, 142, 148; 134/3, 41, 40

[56] References Cited

U.S. PATENT DOCUMENTS

| | | | |
|---|---|---|---|
| 3,988,254 | 10/1976 | Mori | 252/100 |
| 4,009,115 | 2/1977 | Binns | 252/142 |
| 4,057,554 | 11/1977 | Redmore et al. | 260/296 |
| 4,116,853 | 9/1978 | Binns | 252/142 |
| 4,124,407 | 11/1978 | Binns | 252/142 |
| 4,668,421 | 5/1987 | Dollman | 252/136 |

*Primary Examiner*—Paul Lieberman
*Assistant Examiner*—John F. McNally
*Attorney, Agent, or Firm*—Oltrolenk, Faber, Gerb & Soffen

[57] ABSTRACT

The present invention offers a cleaning agent for aluminium surface which is an aqueous acidic liquid containing peroxo acid and/or peroxide in 0.05–10 g/l and further one or more kinds out of sulphuric acid, phosphoric acid and nitric acid.

9 Claims, No Drawings

CLEANING CHEMICAL FOR ALUMINIUM SURFACE

BACKGROUND OF THE INVENTION

1. Field of the Invention

The present invention concerns a chemical for cleaning an aluminium surface. In more detail, it is a cleaning agent for the purpose of removing the lubricant and press oil from an aluminium or aluminium alloy container which remaining thereon after the forming work together with aluminum powder residues (smut); it can further function to reduce contamination and corrosion of cleaning apparatus.

2. Description of the Prior Art

Aluminium or aluminium alloy made containers are usually manufactured through a draw-forming process called drawing and ironing. In the forming work, lubricant or press oil is coated on the metal surface and after the forming, aluminium powder remains adhered on the inner and outer sides of the container.

In general, a container thus formed is surface cleaned, then receives a chemical conversion coating and painting before practical usage.

The surface of the container made of aluminium or its alloy should be made perfectly clean to avoid the existence thereon of contaminants that may hinder the subsequent process of conversion coating or render the container unusable. For this purpose, one measure commonly in use is acid cleaning of the aluminium surface to remove aluminium powder or similar substances from the aluminium container surface. Acid cleaning is done at a temperature from 50° to 80° C. to remove or dissolve away aluminium powder and to take away lubricant or oil used for forming.

Another method is seen in Jap. Pat. Publication Sho 52-22330 (1977), Jap. Laid-open Pat. Sho 61-106783 (1986) etc. wherein an acidic cleaning liquid is proposed which contains ferric ion and thereby can reduce the corrosion of cleaning apparatus.

Problems may arise from the abovementioned first case of acid cleaning in that the heat exchanger is subject to accelerated corrosion by the acid at the heating pipes for cleaning liquid as well as at the conveyor where contact abrasion is constantly taking place.

In order to prevent the apparatus from being corroded by such acid cleaner, chromic acid or chromate has been used. However, use of chromate ion is problematic as it is hazardous.

In the latter case of acid cleaner containing ferric ion, a problem arises from the ferric ion which may adhere onto outer wall of cleaning apparatus where iron rust color develops and the apparatus becomes dirty.

Particularly in the case of a container formed from aluminium or its alloy which is used as a beverage can, the apparatus is required to be specifically clean and neat from a hygienic point of view.

SUMMARY OF THE INVENTION

As the concrete measures for solving the abovementioned problems, the present invention offers a cleaning agent for aluminium surface which is an aqueous acidic liquid containing peroxy acid and/or peroxide in an amount of 0.05–10 g/l and further one or more kinds out of sulphuric acid, phosphoric acid and nitric acid, and whose pH is adjusted to 0.6–2.0.

Through the aid of peroxy acid and/or peroxide therein, said acidic aqueous liquid is able to perform sufficient cleaning, and further, even without containing chromate ion and ferric ion, it is observed to be effective in preventing the apparatus from being corroded; in this way the brown color development rendering the apparatus dirty in the case of using ferric ion can be made nil.

DETAILED DESCRIPTION OF THE INVENTION

In the prior art mentioned above, the chromate ion includes those supplied by chromic acid and chromates of various forms; ferric ion includes those coming from $Fe_2(SO_4)_3$, $Fe(NO_3)_3$, $Fe(ClO_4)_3$ as well as those oxidized by an oxidant from ferrous to ferric ion.

As to peroxy acid and peroxides usable for the present invention, they are peroxosulphuric acid ($H_2SO_5$), peroxosulphate ($M_2SO_5$ where M is $NH_4$, K, Na or H in part), peroxodisulphuric acid ($H_2S_2O_8$), peroxodisulphate ($M_2S_2O_8$ where M is $NH_4$, K, Na etc), peroxoboric acid, ammonium peroxoborate, potassium peroxoborate, sodium peroxoborate, magnesium peroxoborate, lithium peroxoborate, peroxophosphoric acid, peroxodiphosphoric acid, peroxophosphate, peroxomolybdic acid, peroxomolybdate etc.

It should be noted here in particular that these peroxy acids and peroxides have an advantageous property that after having performed their effective action through the decomposition reaction, they can effectively function as a part of builders for the acidic cleaner.

In the acidic cleaner of the present invention, the presence of anionic, cationic or nonionic surface active agent hitherto in use is desirable to the content of 0.1 to 10 g/l preferably or 0.5 to 2 g/l more preferably, since such an agent is effective to enhance the cleaning ability.

In the case of an acidic cleaner that comprizes one or more kinds out of sulphuric acid, phosphoric acid and nitric acid, the surface active agent which can exert particularly effective function is an alkyldimethylamine oxide which is expressed by the following general formula, for which a suitable content is from 0.05 to 2.0 g/l; This surfactant can be used in combination with other surfactants:

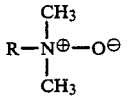

wherein R represents an alkyl radical whose carbon number is from 12 to 22.

The acidic cleaner of the present invention may also contain $F^-$ ion in 0.005″–0.5 g/l (as F in the case of fluoro-complex ion). Addition of $F^-$ in a content lower than 0.005 g/l can not extert its effect; a content exceeding 0.5 g/l makes the etching speed high but caution is necessary with respect to working environments and waste water disposal.

When required, it is also possible to add therein chelate forming compounds such as citric acid, oxalic acid, tartaric acid etc.

To make the present invention cleaner, the method of making an aluminium surface come in contact with a liquid as used for cleaners hitherto publicly-known and being in common use is applicable by means of spray or dip in usual cases. As to cleaning time, a length whose extent causes the surface becomes perfectly wet is satisfactory. Such time length is variable depending on the surface condition and to what extent it is contaminated. In the usual case, however, 10 to 120 sec. is sufficient. As to the application temperature, a temperature from ambient to 80° C., more preferably from 45° C. to 70° C. is advisable.

The aluminum surface cleaned with the present invention cleaner may be chemical conversion treated and painted in the subsequent process.

In the following are described some typical examples and comparative examples which clarify the excellence results that the present invention achieves.

TABLE 1

| | | Treatment solution | | | | | | | Treatment condition | | | | Test results | |
|---|---|---|---|---|---|---|---|---|---|---|---|---|---|---|
| | | Sulphuric acid (g/l) | Phosphoric acid (g/l) | Nitric acid (g/l) | Hydrofluoric acid (g/l) | Surface Active Agent | Peroxy acid (g/l) | | pH | Temp. (°C.) | Time (sec) | Water wettability | Desmutting ability | Corrosion loss of apparatus *1 ($g/m^2$) | Rating of apparatus contamination |
| Example | -1 | 10 | 10 | 10 | 10 | 2.0 | Sodium peroxodisulphate | 0.05 | 0.6 | 70 | 60 | | | 0.17 | |
| | -2 | " | " | " | " | " | Sodium peroxodisulphate | 0.5 | 0.7 | " | " | | | 0.15 | |
| | -3 | " | " | " | " | " | Sodium peroxodisulphate | 5.0 | 0.7 | " | " | | | 0.14 | |
| | -4 | " | " | " | " | " | Sodium peroxodisulphate | 10 | 0.7 | " | " | | | 0.14 | |
| Comparative example | -1 | " | " | " | " | " | Without | | 0.6 | " | " | Δ | Δ | 0.31 | |
| Example | -5 | — | 20 | 5 | — | 1.5 | Ammonium peroxoborate | 0.5 | 0.6 | 60 | 60 | | | 0.13 | |
| | -6 | — | " | " | — | " | Potassium peroxodiphosphate | 0.5 | 0.7 | " | " | | | 0.13 | |
| | -7 | — | " | " | — | " | Sodium peroxodisulphate | 0.5 | 0.6 | " | " | | | 0.13 | |
| Comparative example | -2 | — | " | " | — | " | Without | | 0.7 | " | " | | | 0.15 | |
| Example | -8 | 10 | 10 | — | — | — | Sodium peroxodisulphate | 0.1 | 0.6 | 80 | 90 | Δ | Δ | 0.14 | |
| Comparative example | -3 | — | " | — | — | — | Without | | 0.6 | " | " | X | X | 0.27 | |
| Example | -9 | 5 | — | — | 0.01 | 1.0 | Potassium peroxodisulphate | 1.0 | 0.6 | 50 | 60 | | | 0.14 | |
| Comparative example | -4 | " | — | — | — | " | $Fe^{3+}$ | 0.1 | 0.6 | " | " | | | 0.14 | X |
| Laid-open pat. 61-106783 | | | | | | | | | | | | | | | |
| Example | -10 | 3 | 3 | 1 | — | 1.5 | Ammonium peroxodisulphate | 10 | 1.2 | 70 | 60 | | | 0.13 | |
| | | | | | | | Ammonium peroxomolybdate | 0.1 | | | | | | | |
| Comparative example | -5 | " | " | " | — | " | $Fe^{3+}$ | 0.5 | 0.6 | " | " | Δ | Δ | 0.13 | X |
| Laid-open pat. 61-106783 | | | | | | | | | | | | | | | |

*1 Corrosion loss: weight loss of SUS 316 after 2 months
(good) Δ X (poor)

As described hereinbefore in regard to its function, effect and excellence, the present invention offers a cleaning chemical for aluminium surface which is an aqueous acidic liquid containing peroxy acid and/or peroxide in 0.05–10 g/l and further comprizing one or more of sulphuric acid, phosphoric acid and nitric acid and adjusted to 0.6–2.0 in the pH. The present invention particularly specifies a cleaning liquid that contains peroxy acid and/or peroxides and does not contain chromate ion or iron ion; such a liquid brings about the effect that not only the working environment can be kept clean without contamination and waste water disposal load can be lightened but also reduction in the corrosion of cleaning apparatus can be attained.

We claim:

1. A cleaning chemical for removing lubricants and press oils from an aluminum containing surface comprising an aqueous acidic liquid which contains water, 0.05 to 10 grams per liter of a peroxy acid or salt thereof, 0.05 to 2 grams per liter of an alkyl dimethylamine oxide surface active agent of the formula

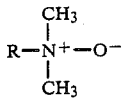

in which R is $C_{12-22}$ alkyl, and at least one member of the group consisting of sulfuric acid, phosphoric acid and nitric acid containing 0.005 to 0.5 gram per liter of fluoride ion and said liquid having a pH of from 0.6 to 2.0.

2. A cleaning chemical for aluminum surface according to claim 1 in which the amount of surface active agent is 1.5–2 grams per liter.

3. A cleaning chemical for aluminum surface according to claim 1 containing sulfuric acid, phosphoric acid and nitric acid in a combined amount of 5 to 30 grams per liter.

4. A cleaning chemical for aluminum surface according to claim 1 in which the peroxy acid or salt is selected from the group consisting of sodium peroxodisulfate, ammonium peroxoborate, potassium peroxodiphosphate, potassium peroxodisulfate, ammonium peroxodisulfate and ammonium peroxomolybdate.

5. A cleaning chemical for the removal of lubricants and press oils from an aluminum containing surface consisting essentially of water, 0.05 to 10 grams per liter of a peroxy acid or salt thereof, 0.05 to 2 grams per liter of an alkyl dimethylamine oxide surface active agent of the formula

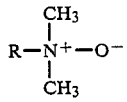

in which R is $C_{12-22}$ alkyl, up to 0.5 gram per liter of fluoride ions and at least one member selected from the group consisting of sulfuric acid, phosphoric acid and nitric acid, in a combined amount of 5 to 30 grams per liter said liquid having a pH of from 0.6 to 2.0.

6. A cleaning chemical for an aluminum surface according to claim 5 in which the amount of surface active agent is 1.5 to 2 parts, the amount of said member of the acid group is is 5 to 30 grams per liter and in which said fluoride ions are provided by 0.01 to 10 grams per liter of hydrofluoric acid.

7. The cleaing chemical for an aluminum surface according to claim 6 in which at least 2 members of said group are present.

8. The cleaning chemical for an aluminum surface according to claim 6 in which at least 3 members of said group are present.

9. A cleaning chemical for aluminum surface according to claim 5 in which the peroxy acid or salt is selected from the group consisting of sodium peroxodisulfate, ammonium peroxoborate, potassium peroxodiphosphate, potassium peroxodisulfate, ammonium peroxodisulfate and ammonium peroxomolybdate.

* * * * *